US008669521B2

(12) United States Patent
Blick et al.

(10) Patent No.: US 8,669,521 B2
(45) Date of Patent: Mar. 11, 2014

(54) MICROWAVE CAVITY DETECTOR FOR MASS SPECTROMETRY

(75) Inventors: Robert H. Blick, Madison, WI (US); Jonghoo Park, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 174 days.

(21) Appl. No.: 12/890,141

(22) Filed: Sep. 24, 2010

(65) Prior Publication Data

US 2012/0074313 A1 Mar. 29, 2012

(51) Int. Cl.
*H01J 49/40* (2006.01)
*H01J 49/02* (2006.01)

(52) U.S. Cl.
USPC ..... 250/287; 250/282

(58) Field of Classification Search
USPC ..... 250/282, 287, 397; 324/459–470, 637
See application file for complete search history.

(56) References Cited

U.S. PATENT DOCUMENTS

| | | | | |
|---|---|---|---|---|
| 3,446,957 | A * | 5/1969 | Llewellyn et al. | 250/291 |
| 5,210,412 | A * | 5/1993 | Levis et al. | 250/288 |
| 5,451,794 | A * | 9/1995 | McKeown et al. | 250/492.3 |
| 6,133,800 | A * | 10/2000 | Deng | 331/94.1 |
| 7,679,374 | B2 * | 3/2010 | Bromberg et al. | 324/637 |
| 2002/0190205 | A1 * | 12/2002 | Park | 250/292 |
| 2003/0020480 | A1 * | 1/2003 | Maylotte et al. | 324/464 |
| 2004/0169137 | A1 * | 9/2004 | Westphall et al. | 250/281 |
| 2005/0032233 | A1 * | 2/2005 | Gopalsami et al. | 436/149 |
| 2008/0035612 | A1 * | 2/2008 | Chang et al. | 219/121.44 |
| 2008/0059093 | A1 * | 3/2008 | Bromberg et al. | 702/76 |
| 2008/0319285 | A1 * | 12/2008 | Hancock | 600/309 |
| 2009/0020694 | A1 * | 1/2009 | Flory | 250/282 |
| 2010/0180577 | A1 * | 7/2010 | Gonze et al. | 60/277 |
| 2011/0057653 | A1 * | 3/2011 | Barmatz et al. | 324/316 |
| 2011/0147581 | A1 * | 6/2011 | Chen et al. | 250/282 |
| 2011/0156617 | A1 * | 6/2011 | Takayama et al. | 315/503 |

OTHER PUBLICATIONS

Simon, et al., Performance of a reentrant cavity beam position monitor, Physical Review Special Topics—Accelerators and Beams 11, 082802 (2008).*

Estey, Brian V., et al., Time-of-Flight Mass Spectrometry with Latching Nb Meander Detectors, vol. 19, No. 3, Jun. 2009, pp. 382-385, IEEE Transactions on Applied Superconductivity, IEEE, New York, NY, USA.

* cited by examiner

*Primary Examiner* — David A Vanore
*Assistant Examiner* — Wyatt Stoffa
(74) *Attorney, Agent, or Firm* — Boyle Fredrickson, S.C.

(57) ABSTRACT

A detector for time of flight mass spectroscopy uses a microwave resonant cavity excited into resonance by the passage of charged particles as an ion detector. With proper configuration of the frequency of resonance of the cavity, its modes and its quality factor, nanosecond time resolution, should be possible.

20 Claims, 2 Drawing Sheets

MICROWAVE CAVITY DETECTOR FOR MASS SPECTROMETRY

STATEMENT REGARDING FEDERALLY SPONSORED RESEARCH OR DEVELOPMENT

This invention was made with United States government support awarded by the following agencies:

USAF/AFOSR FA9550-08-1-0337

The United States government has certain rights to this invention.

CROSS REFERENCE TO RELATED APPLICATION

- - -

BACKGROUND OF THE INVENTION

The present invention relates to mass spectrometers and in particular to a high-resolution detector for time of flight spectrometers.

Mass spectrometers are analytic instruments that may provide for the precise measurement of the mass of molecules. Generally, the molecules to be measured are given an electrical charge and then accelerated by an electrical field. The velocity of their acceleration will be generally proportional to the mass to charge ratio (m/z) and so for a given and known charge the mass may be precisely determined by a velocity measurement.

One method of determining velocity is the use of a "sector" type analyzer which bends the trajectories of the charged particles using a magnetic field. When the particles exit the magnetic field, the angle of their trajectories (and spatial separation at a measurement point) will be in proportion to m/z and may be measured by a series of spatially separated collectors.

An alternative detection system uses a "time of flight" analyzer in which relative velocities of different molecular species are deduced based on the time it takes them to reach a detector. Common detectors used for time of flight analysis include so-called "Faraday cups" which are conductive metal cups, which catch charged particles and are attached to sensitive electrical amplifiers and "dynode" detectors which provide an amplification of received charge through electron multiplier techniques.

Mass spectrometry is increasingly applied to extremely large molecules, for example proteins, that may be ionized by various techniques such as matrix assisted laser desorption/ionization (MALDI) in which the fragile proteins are protected with a matrix material that is struck by a laser beam. The matrix absorbs the energy of the beam and is removed from the protein while transferring a charge to the protein.

The large mass of protein molecules decreases the sensitivity of a time of flight spectrometer to the extent that the velocity of the proteins is lower and thus the difference between velocities of similar masses is less. This requires that the difference in measured times of flight must be resolved more precisely. Conventional spectrometer detectors can exhibit latencies that hide small mass differences for large molecules thus limiting the mass resolving power of the spectrometer.

SUMMARY OF THE INVENTION

The present invention provides a detector for mass spectrometers employing a tuned microwave cavity. Charged particles passing through the cavity create an electrical field that can be detected by an antenna coupled to the cavity. With high quality factor cavities, time resolutions on the order of 1-ns should be possible.

Specifically, the present invention provides a detector for use in a mass spectrometer of a type providing a source of ionized molecules, for analysis, that are then accelerated in an acceleration field before reaching the detector. The detector includes a cavity of conductive material providing an electromagnetically tuned cavity, the cavity having an opening positioned to receive molecules after acceleration by the acceleration field along an axis into the cavity. An antenna communicates with the cavity to receive an electrical signal caused by electromagnetic resonance of the cavity; and detection electronics receive the electrical signal to distinguish a time of arrival of the ionized molecule in the cavity.

It is thus a feature of at least one embodiment of the invention to provide a novel detector for time of flight mass spectrometry providing potentially high temporal resolution.

The cavity may have a resonant frequency in the TM-010 mode of no less than 500 MHz and preferable in no less than 1.5 GHz. The cavity may have a quality factor (Q) in excess of 4000 or preferably in excess of 7000

It is thus a feature of at least one embodiment of the invention to provide time resolutions suitable for time of flight measurements of large molecules such as proteins.

The antenna may be a first conductive stub placed at a first anti-node for the TM110 mode and referenced to a second conductive stub placed at a second anti-node for the TM110 mode having a phase shift with respect to the first anti-node of an odd multiple of $\pi$.

It is thus a feature of at least one embodiment of the invention to provide an antenna system effectively capturing energy generated by small charges passing through the cavity.

The cavity may be radially symmetric about the axis and/or may be a reentrant resonant cavity.

It is thus a feature of at least one embodiment of the invention to provide a manufacturable high-Q cavity suitable for ion detection.

The cavity may provide a through passage along the axis from the opening to a cavity exit.

It is thus a feature of at least one embodiment of the invention to provide a cavity that can be used in a mass spectrometer without accumulation of material in the cavity.

The detector may further include an isolator providing for an isolation of direct current voltages between the antenna and the detector circuitry.

It is thus a feature of at least one embodiment of the invention to provide a sensitive electrical measurement device that can be biased with the necessary field voltages needed in a mass spectrometer.

The conductive material may be copper.

It is thus a feature of at least one embodiment of the invention to provide an extremely high Q resonant cavity suitable for high-speed ion measurements.

These particular objects and advantages may apply to only some embodiments falling within the claims and thus do not define the scope of the invention.

DETAILED DESCRIPTION OF THE PREFERRED EMBODIMENT

Figure 1:
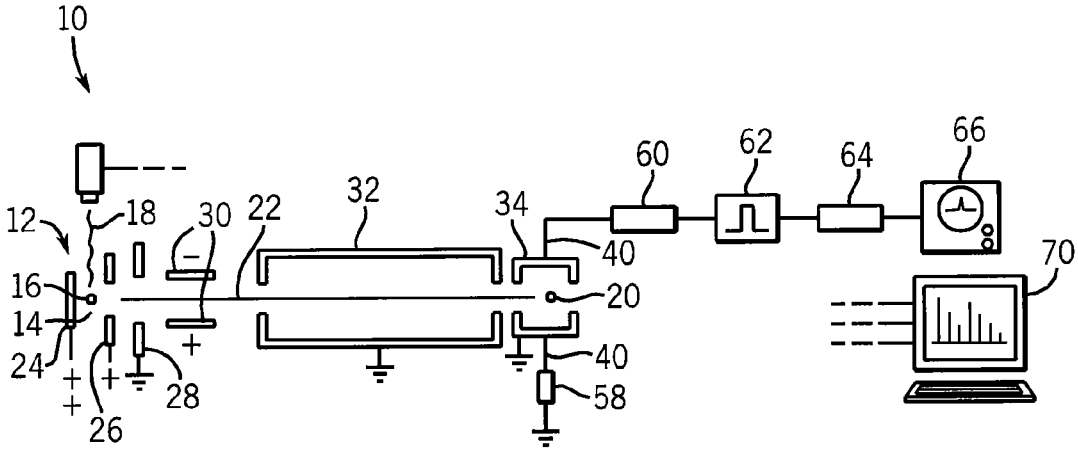
FIG. 1 is a simplified diagram of a matrix assisted laser desorption/ionization, time of flight (MALDI-TOF) mass spectrometer using a detector of the present invention.

Referring now to FIG. 1, an example mass spectrometer 10 suitable for use with the present invention may include an ion generator 12, for example, providing an introduction zone 14 into which matrix treated molecules 16 may be introduced and targeted by a laser 18 to provide a source of ions 20.

The ions 20 may be accelerated along a travel axis 22 by means of various accelerating plates, for example, a repeller plate 24 position on a rear side of the introduction zone 14 and an attractor plate 26 position on the front side of the introduction zone 14 (in the direction of desired ion travel) with the attractor plate 26 having a relatively lower electrical potential than the repeller plate 24 (for positive ions). An accelerator plate 28 in front of the attractor plate 26 may further accelerate the ions 20 to a desired speed. The ions 20 may be focused by a set of steering plates 30 as understood in the art to enter a flight tube 32 providing a zone when the ions 20 of different velocities may further separate improving the resolution of the system. The ions may then enter a detector 34.

Figure 2:
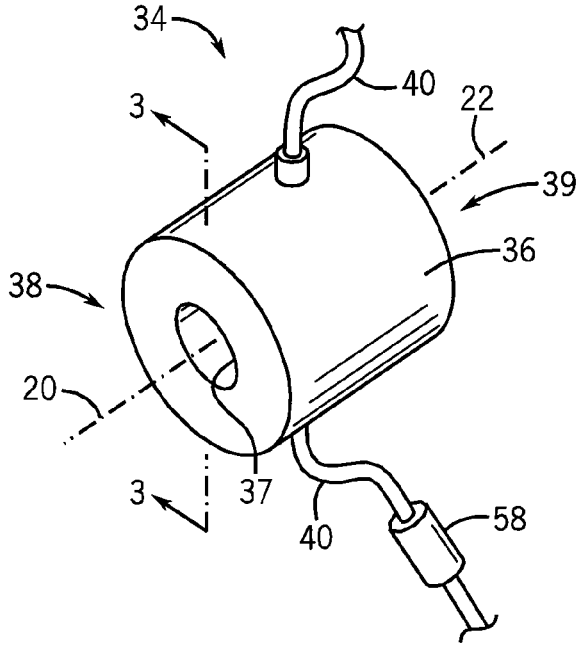
FIG. 2 is a perspective view of the detector of FIG. 1.

Referring now to FIG. 2, the detector 34 of the present invention may be an electrically resonant microwave cavity, for example, having a conductive copper body 36 defining a cavity volume 37. In one embodiment, the cavity volume 37 may have rotational symmetry about the axis 22 and provide an inlet port 38 and exit port 39 aligned with and opposed along the axis 22 to receive and expel ions 20. Ions 20, as they pass along the axis 22 through the detector 34, excite the resonant microwave cavity to produce an electrical signal that may be detected as a voltage generated across leads 40 connected to internal antennas within the detector 34 as will be described.

Figure 3:
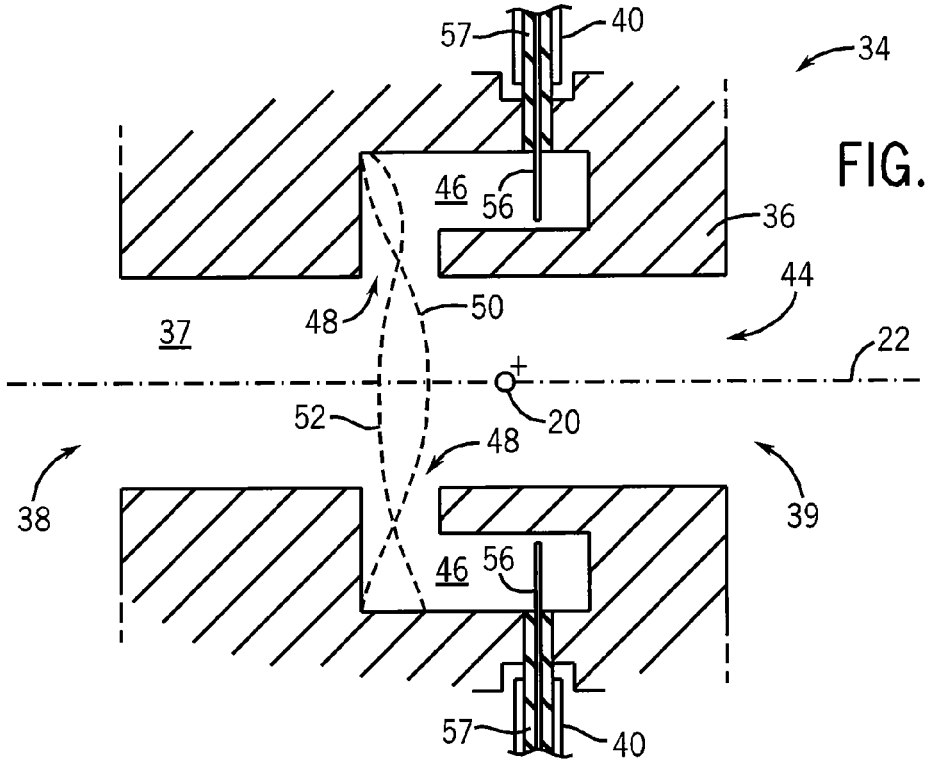
FIG. 3 is a fragmentary cross-sectional view of the detector of FIG. 2 taken along line 3-3.

Referring now to FIG. 3, the detector 34 may, for example, be machined from one or more solid blocks of conductive material for dimensional stability, for example an oxygen free copper, assembled together to provide a central cylindrical cavity 44 and a cylindrical annular side cavity 46 concentric about axis 22 and communicating with the central cylindrical cavity by means of a radially extending slot 48 joining the central cylindrical cavity 44 with a rear base of the annular side cavity 46. The cavity so formed provides a so-called reentrant resonant cavity.

The ions 20 passing through the cavity along axis 22 excite a monopole resonance in the TM010 mode 50 as well as a TM 110 mode resonance 52. This latter resonance may be detected by means of stub antennas 56 extending radially inward into the annular side cavities 46 at the front end of the annular cavities diametrically opposed across axis 22. The stub antennas 56 are short conductors supported by feedthrough insulators 57 in the body 36 of the detector 34 and connected to coaxial cable leads 40.

These antennas 56 are positioned to couple to the antinodes of the TM110 mode. The energy in the TM110, like the TM010 mode, will largely be proportional only to the molecular ion beam intensity and not the ion velocity.

Figure 4:
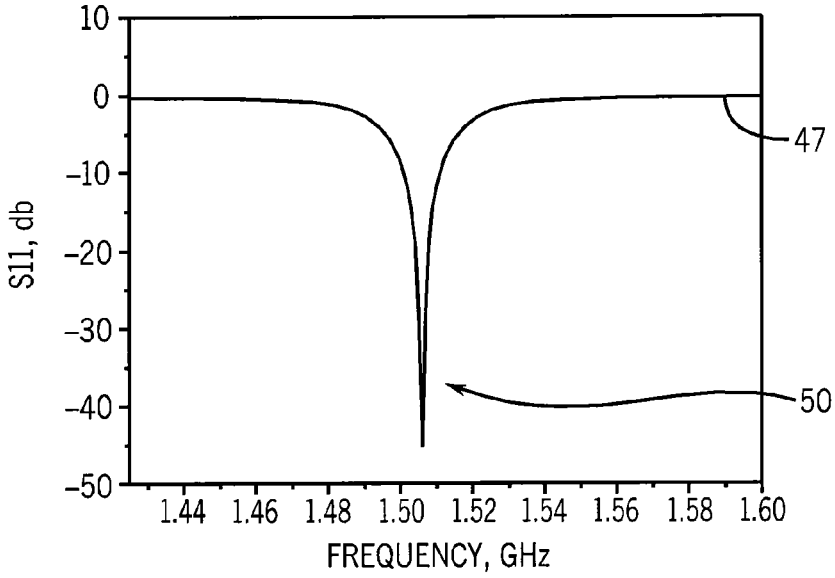
FIG. 4 is a plot of the radiofrequency (RF) characteristics of the detector of FIG. 2 showing its high quality value and tuning.

Referring now also to FIG. 4, a plot 47 of antenna gain for the detector 34 as a function of frequency shows a preferred design characteristic where the cavity is tuned to have a fundamental TM010 mode in microwave frequencies, for example, 1.5 GHz and a quality factor calculated to be 7400 or higher.

The resolution of the cavity will be generally given by the following formula:

$$\tau = \frac{1}{\pi B}$$

where B is the bandwidth defined by the relationship:

$$B = \frac{f_d}{Q_{ld}}$$

where $f_d$ is the frequency of the resonant cavity and $Q_{ld}$ is the quality factor for the cavity. With a calculated intrinsic quality factor of 7400, nanosecond time resolution should be obtained with this cavity.

Referring again to FIG. 1, one lead 40 may be referenced to a signal ground through a terminating resistor 58 (e.g. 50 ohms) and the other lead 40 may be connected to a DC isolator 60, for example a blocking capacitor, isolating the detection circuitry to be described from the voltages of the spectrometer. In this way the body 36 of the detector 34 may be electrically biased with respect to the plates 24, 26 and 28 as necessary, for example at a ground point different from the signal ground.

A band pass filter 62 centered about the desired modal frequency (e.g. 1.5 GHz) may receive the signal from the isolator 60 to reduce other frequencies outside of the resonance of the cavity to improve signal-to-noise ratio. The output of the band pass filter 62 may be connected to a detector 64 (for example, a square law or diode type detector) to extract an amplitude value of the cavity resonance that may be used to signal passage of an ion 20, for example, by threshold detection.

In one embodiment the output of the detector 64 they be provided to a high-speed oscilloscope 66 used to measure time of arrival of the ion 20 and hence the time of flight of the ion 20. Alternatively the signal from detector 64 may be provided to a microprocessor system 68 typically associated with such spectrometers receiving an ion initiation time signal, for example from the laser 18, to provide a spectrographic output 70.

The present invention is not limited to a mass spectrometer of the MALDI-TOF design as described in simplified form above but may be used in any time of flight mass spectrometers including those that provide for reflection of the ions and other features well known in the art. It is anticipated that other configurations of resonant cavities may be also be used provided they exhibit the necessary frequency and Q characteristics. Although the present detector is particularly desirable for large molecules such as proteins where high temporal resolution is required, it may find use in general-purpose spectroscopy as well.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference, which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor," can be understood to include one or more microprocessors that can communicate in a stand-alone and/or a distributed environment(s), and can thus be configured to communicate via wired or wireless communications with other processors, where such one or more processors can be configured to operate on one or more processor-controlled devices that can be similar or different devices. Furthermore, references to memory, unless otherwise specified, can include one or more processor-readable and accessible memory elements and/or components that can be internal to the processor-controlled device or external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A time of flight detector for use in a mass spectrometer comprising:

a source of ionized molecules for analysis, wherein a first electrical signal indicating an ion initiation time is provided, and an acceleration field accelerating the ionized molecules in an electric field;

a cavity of conductive material providing an electromagnetically tuned cavity, the cavity having an opening positioned to receive the ionized molecules after acceleration by the acceleration field along an axis into the cavity;

an antenna communicating with the cavity to receive a second electrical signal caused by electromagnetic resonance of the cavity induced by passage of the ionized molecules along the axis into the cavity;

detection electronics receiving the first and second electrical signals to distinguish a time of arrival of the ionized molecules in the cavity along the axis into the cavity relative to the ion initiation time; and a display providing a spectrographic output distinguishing among the ionized molecules according to their mass to charge ratio.

2. The time of flight detector of claim 1 wherein the cavity has a resonant frequency in a TM010 mode of no less than 500 MHz.

3. The time of flight detector of claim 2 wherein the cavity has a resonant frequency in the TM 010 mode of no less than 1.5 GHz.

4. The time of flight detector of claim 1 wherein the cavity has quality factor in excess of 4000.

5. The time of flight detector of claim 4 wherein the cavity has quality factor in excess of 7000.

6. The time of flight detector of claim 1 wherein the antenna is a first conductive stub placed at a first anti-node for a TM110 mode and referenced to a second conductive stub placed at a second anti-node for the TM110 mode having a phase shift with respect to the first anti-node of an odd multiple of $\pi$.

7. The time of flight detector of claim 1 wherein the cavity is radially symmetric about the axis.

8. The time of flight detector of claim 1 wherein the cavity is a reentrant resonant cavity.

9. The time of flight detector of claim 1 wherein the cavity provides a through passage along the axis from the opening to a cavity exit.

10. The time of flight detector of claim 1 further including an isolator providing for an isolation of direct current voltages between the antenna and the detection electronics.

11. The time of flight detector of claim 1 wherein the conductive material is copper.

12. A method of characterizing molecular weights comprising the steps of:

(a) providing a source of ionized molecules for analysis;

(b) providing a first electrical signal indicating an ion initiation time;

(c) accelerating the ionized molecules in an electric field;

(d) receiving the accelerated ionized molecules in a cavity of conductive material providing an electromagnetically tuned cavity, the cavity having an opening positioned to receive the ionized molecules after acceleration by the acceleration field along an axis into the cavity;

(e) detecting a second electrical signal induced within the cavity by the received molecules through an antenna communicating with the cavity to receive an electrical signal caused by electromagnetic resonance of the cavity induced by passage of the ionized molecules along the axis into the cavity;

(f) analyzing the first and second electrical signals with detection electronics to distinguish a time of arrival of the ionized molecules in the cavity along the axis into the cavity relative to the ion initiation time; and (g) displaying a spectrographic output distinguishing among the ionized molecules according to their mass to charge ratio.

13. The method of claim 12 wherein the cavity has a resonant frequency in a TM010 mode of no less than 500 MHz.

14. The time of flight detector of claim 13 wherein the cavity has a resonant frequency in a TM010 mode of no less than 1.5 GHz.

15. The method of claim 12 wherein the cavity has quality factor in excess of 4000.

16. The method of claim 15 wherein the cavity has quality factor in excess of 7000.

17. The method of claim 12 wherein the antenna is a first conductive stub placed at a first anti-node for the TM110 mode and referenced to a second conductive stub placed at a second anti-node for the TM110 mode having a phase shift with respect to the first anti-node of an odd multiple of $\pi$.

18. The method of claim 12 wherein the cavity is a reentrant resonant cavity.

19. The method of claim 12 wherein the cavity provides a through passage along the axis from the opening to a cavity exit.

20. The method of claim 12 wherein the conductive material is copper.

* * * * *